United States Patent [19]

Kritzer

[11] 4,349,949

[45] Sep. 21, 1982

[54] METHOD OF MAKING HEAT EXCHANGERS

[76] Inventor: Richard W. Kritzer, 400 E. Randolph, Chicago, Ill. 60601

[21] Appl. No.: 204,210

[22] Filed: Nov. 5, 1980

[51] Int. Cl.[3] ..... B23P 15/26

[52] U.S. Cl. ..... 29/157.3 A; 165/179; 165/133; 29/157.3 B; 409/293

[58] Field of Search ..... 29/157.3 A, 157.3 B, 29/157.3 R, 157.3 C, 157.4; 165/179, 133; 228/183; 409/293

[56] References Cited

U.S. PATENT DOCUMENTS

| | | | |
|---|---|---|---|
| 3,886,639 | 6/1975 | Pasternak | 29/157.3 A |
| 3,901,312 | 8/1975 | Pasternak | 29/157.3 A |
| 4,203,311 | 5/1980 | O'Connor et al. | 29/157.3 A |

*Primary Examiner*—Francis S. Husar
*Assistant Examiner*—V. K. Rising
*Attorney, Agent, or Firm*—Emrich, Lee, Brown & Hill

[57] ABSTRACT

The method of making elongated heat exchangers having outwardly projecting fins spaced longitudinally thereof, wherein the fins are cut or gouged from a work-piece while the work-piece and cutting tool are vibrated relative to each other to afford roughened surfaces on both faces of the fins facing longitudinally of the heat exchanger.

6 Claims, 6 Drawing Figures

55b
62
54b
56
60
58
59
2
8
7
9
61
10
13
17
57
52b
6

METHOD OF MAKING HEAT EXCHANGERS

BACKGROUND OF THE INVENTION

This invention relates to methods of making heat exchangers and, more particularly, to methods of making heat exchangers having outwardly projecting fins spaced longitudinally therealong, and wherein both of the longitudinally facing faces of the fins have roughened surfaces.

It is a primary object of the present invention to afford a novel method of making a heat exchanger.

Another object is to afford a novel method of making a heat exchanger wherein external fins are formed by cutting or gouging the same from wall portions of the heat exchanger.

Another object of the present invention is to afford a novel method of making a heat exchanger of the spined type and wherein the spines are formed from outwardly projecting ribs on the heat exchanger.

A further object of the present invention is to afford a novel method of making a heat exchanger of the spined type wherein the spines are formed as integral parts of larger fin members by cutting or gouging the spines from outwardly projecting ribs and cutting or gouging the remainder of the fin members from material underlying the ribs.

The making of spined heat exchangers by cutting or gouging the spines from outwardly projecting ribs on a tubular member has been heretofore known in the art, being shown, for example, in my earlier U.S. Pat. No. 3,202,212, issued Aug. 24, 1965; and in U.S. Pat. Nos. 3,866,286, issued to Stephen F. Pasternak, on Feb. 18, 1975; 3,886,639, issued to Stephen F. Pasternak, on June 3, 1975; and 3,947,941, issued to Joseph M. O'Connor, on Apr. 6, 1976.

Also, making of spined heat exchangers wherein the spines are formed as integral parts of a larger fin member by cutting or gouging the spines from outwardly projecting ribs and cutting or gouging the remainder of the fin members from material underlying the ribs has been heretofore known in the art, being shown, for example, in U.S. Pat. No. 3,693,105, issued to Joseph M. O'Connor, on Sept. 19, 1972, and in my co-pending application for U.S. Pat. No. 205,795 filed Nov. 10, 1980.

It is an important object of the present invention to afford a novel method of forming finned and/or spined heat exchangers.

It is known that in the making of finned and/or spined heat exchangers in accordance with the teachings of all of the aforementioned patents and the aforementioned patent application, the faces of the fins, facing in the direction of the travel of the cutting tool in the making of the cut, are substantially roughened. Such roughening commonly is in the nature of bubbles having a thickness of 0.001 to 0.002" on fins having an over-all thickness of 0.009". This, in spite of the fact that the reverse sides of such fins, and the underlying surfaces of the work-piece, from which the fins have been cut or gouged, are shiny smooth in nature. It is my opinion that such roughening of the one side of such fins is caused by the thickening and foreshortening of the fins during the gouging action cuts of substantially less thickness (such as 0.003") and of greater length (such as 1.125") being used to produce fins of substantially greater thickness (such as 0.009") and lesser length (such as 0.4").

It has been found that even having the one roughened surface on such fins is advantageous in a heat transfer member, affording a greater heat-transfer surface area; assisting in breaking up laminar flow past the fins; creating turbulence in the working fluid passing between the fins; and tending to break up the boundary layers of working fluid disposed immediately adjacent to such roughened surfaces.

It is an important object of the present invention to increase such advantageous performances of heat transfer members by enabling both sides of such fins to be roughened.

Another object of the present invention is to afford a novel method of making finned and/or spined heat exchangers wherein both opposite sides of the fins and/or spines are roughened.

Another object of the present invention is to afford a novel method of making finned and/or spined heat exchangers of the aforementioned type, wherein the work-pieces and cutters are vibrated relative to each other in a novel and expeditious manner during the forming of such fins and/or spines.

A further object of the present invention is to afford a novel method of making finned and/or spined heat exchangers of the aforementioned type wherein the cutter is vibrated relative to the work-piece during a cutting or gouging operation.

Another object of the present invention is to afford a novel method of making a finned and/or spined heat exchanger of the aforementioned type wherein the work-piece is vibrated relative to the cutter during a cutting or gouging operation.

Another object of the present invention is to afford a novel method of making heat exchangers which is effective to afford, in a novel and expeditious manner, increased turbulence in air or other working fluid passing across the completed heat exchanger.

Other and further objects of the present invention will be apparent from the following description and claims and are illustrated in the accompanying drawings which, by way of illustration, show preferred embodiments of the present invention and the principles thereof and what I now consider to be the best modes in which I have contemplated applying these principles. Other embodiments of the invention embodying the same or equivalent principles may be used and changes may be made as desired by those skilled in the art without departing from the present invention and the purview of the appended claims.

DESCRIPTION OF THE EMBODIMENTS SHOWN HEREIN

A method of making a heat exchanger element, together with apparatus and material for practicing the same are shown in FIGS. 1-4 of the drawings to illustrate the presently preferred method of making heat exchangers in accordance with the principles of the present invention.

Figures 5, 6:
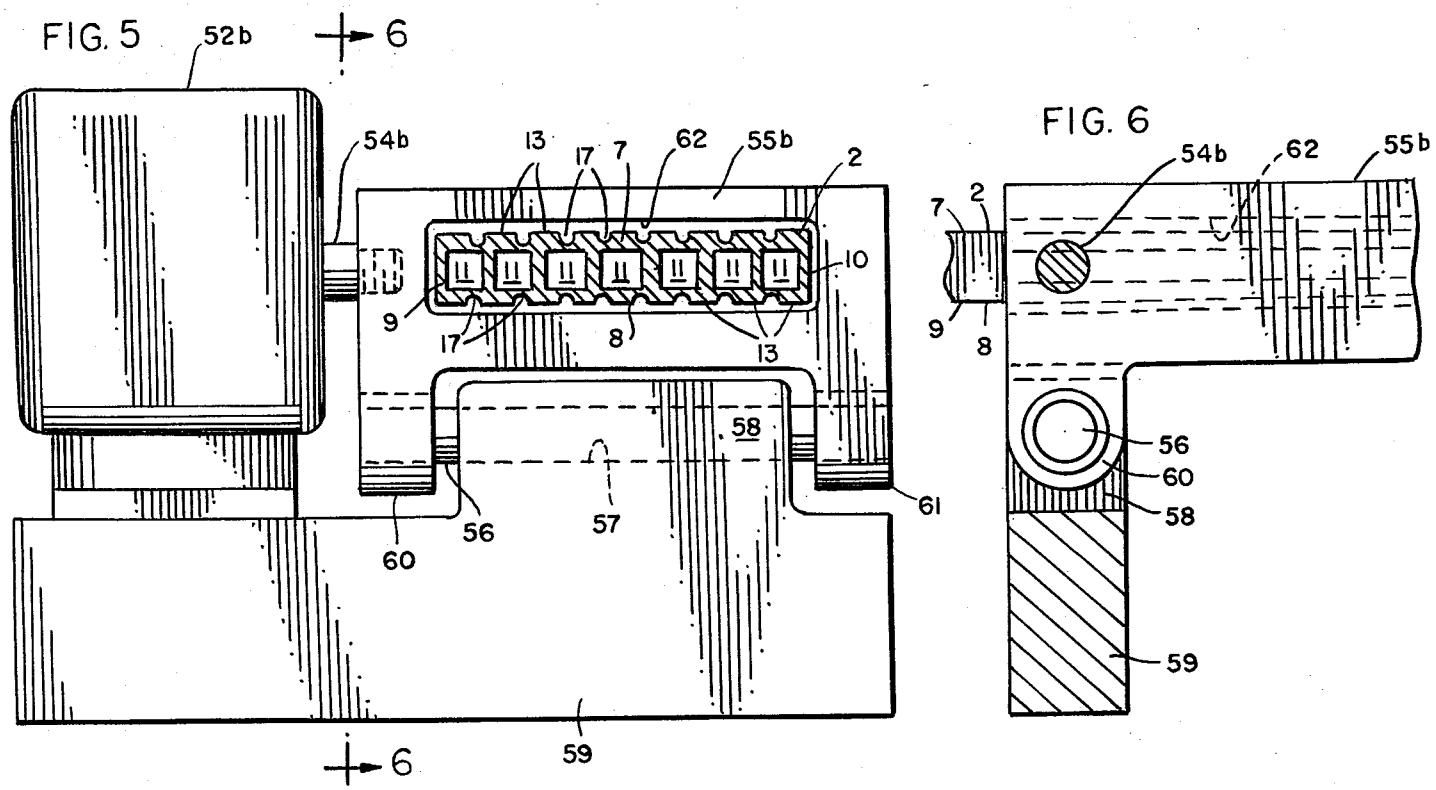
FIG. 5 is a rear elevational view of a work-holder adapted to perform a modified form of my novel method, the view being in the direction of the arrows 5—5 in FIG. 1, if the work-holder, shown in FIG. 5, were embodied in apparatus of the type shown in FIG. 1.
FIG. 6 is a fragmentary, detail sectional view taken substantially along the line 6—6 in FIG. 5.

As will be discussed in greater detail hereinafter, in the preferred practice of the present invention a heat exchanger element 1 is formed from a suitable length of tubular stock, such as the tubular member 2, FIG. 1 working from one end portion A of the tubular member 2 toward the other end B thereof, and severing the heat exchanger 1 from the remainder B-C of the tubular member 2 upon completion of the forming of the desired length of heat exchanger, such as the length A-C. Preferably, the tubular member 2 is substantially rectangular in transverse cross-section, as shown in FIG. 5 of the drawings with respect to a modified form of the present invention.

Figure 1:
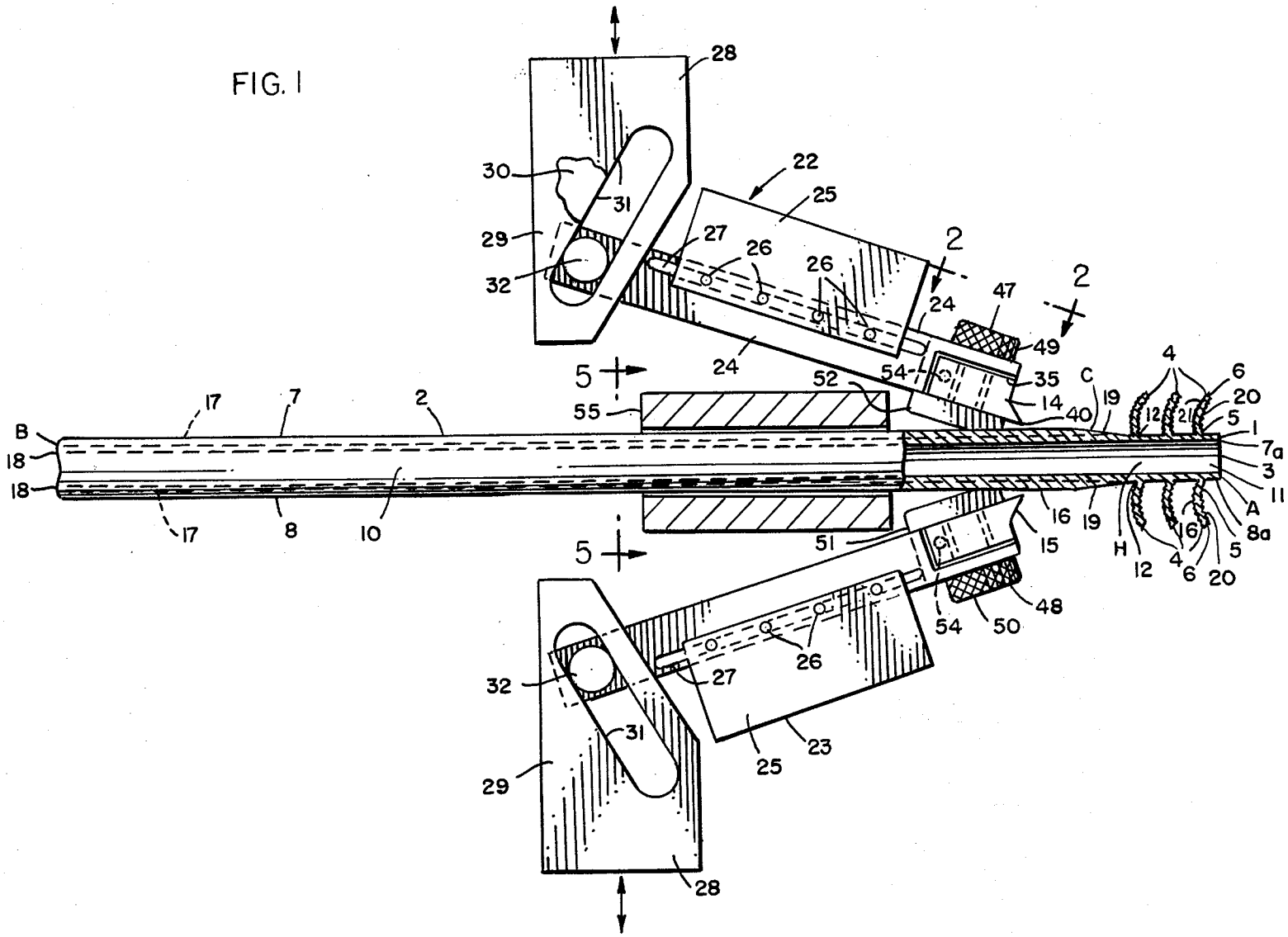
FIG. 1 is a somewhat diagrammatic showing of apparatus adapted to perform the presently preferred form of my novel method.
Figure 2:
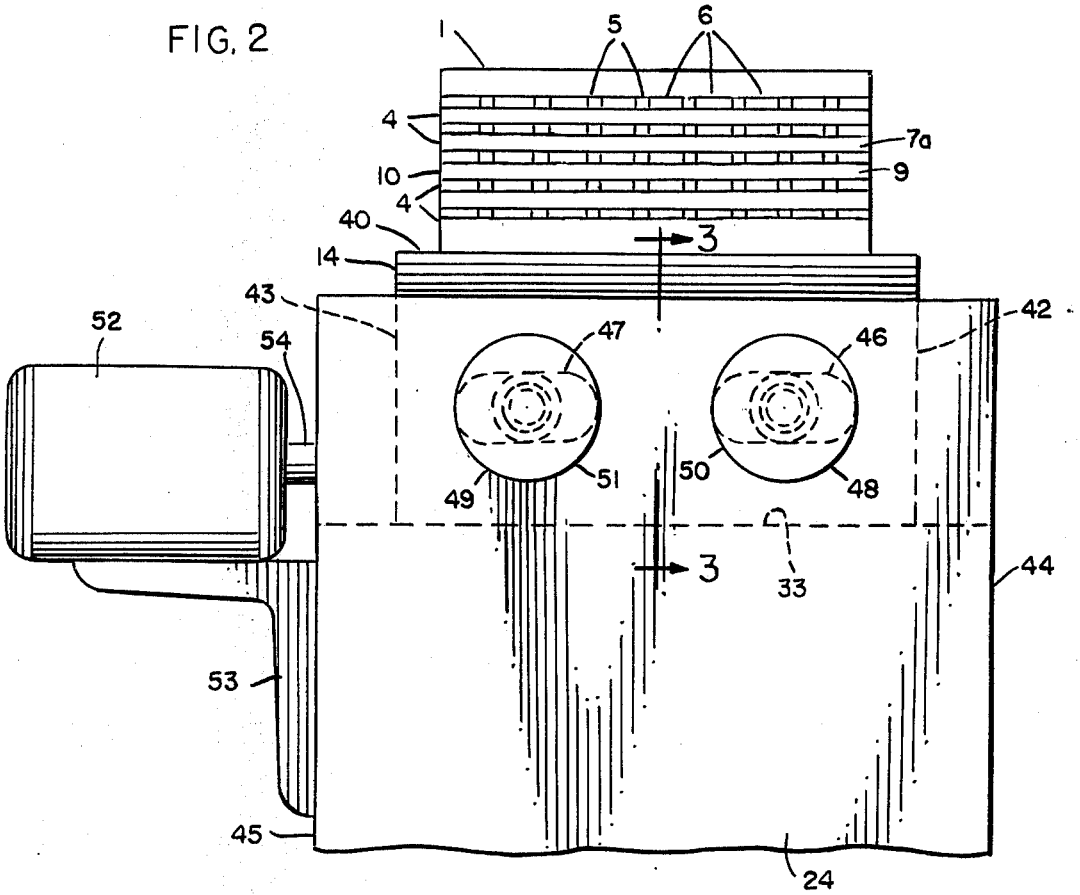
FIG. 2 is a fragmentary, top plan view of a portion of the apparatus shown in FIG. 1, looking in the direction of the arrows 2—2 in FIG. 1.

The heat exchanger element 1, afforded by the aforementioned preferred form of the present method, embodies, in general, an elongated tubular body portion 3 having elongated fins 4 projecting outwardly therefrom, each of the fins 4 embodying an elongated base portion 5 having a plurality of spines 6 projecting outwardly from one longitudinal edge thereof, FIGS. 1 and 2. Preferably, the fins are of the general type of the spined fins shown in the aforementioned O'Connor Pat. No. 3,692,105.

It will be remembered that the tubular member 2 shown in the drawings is substantially rectangular in transverse cross-section, embodying a top wall 7 and a bottom wall 8 disposed in substantially parallel relation to each other, and two oppositely disposed side walls 9 and 10 extending between respective sides of the side walls 7 and 8 in substantially perpendicular relation thereto. A plurality of openings 11 extend longitudinally through the tubular member 2, FIG. 5. As will be appreciated by those skilled in the art, the tubular member 2 is shown herein as being rectangular in transverse cross-section and having a plurality of openings 11 extending longitudinally therethrough merely by way of illustration and not by way of limitation, and tubular members having shapes other than rectangular and having a single opening extending longitudinally therethrough may be afforded without departing from the purview of the present invention.

In the heat exchanger 1 shown in the drawings, the fins 4 project outwardly from the outer faces of two walls 7*a* and 8*a*, FIG. 1, corresponding to, and, in fact, formed from the walls 7 and 8 of the tubular member 2, as will be discussed in greater detail presently. The fins 4 extend longitudinally across the respective walls 7*a* and 8*a* in a direction transverse to the length of the tubular body portion 2, and each of the fins 4 embodies one of the aforementioned base portions 5 having a lower longitudinal edge portion 12 integral with the respective wall 7*a* or 8*a* to which it is attached. Each base portion 5 projects outwardly from the respective one of the wall 7*a* and 8*a*, preferably in substantially perpendicular relation thereto, with the spines 6 thereon spaced along and projecting outwardly from the longitudinal edge of the base portion 5 remote from the wall 7*a* or 8*a*.

The tubular member 2, from which the heat exchanger 1, shown in the drawings, is made, may be made of any suitable material, such as, for example, aluminum, and embodies a plurality of elongated outwardly projecting ribs 13, FIG. 5, on the outer face of each of the side walls 7 and 8, the ribs 13 extending longitudinally of the tubular member 2 in parallel spaced relation to each other.

In making the heat exchanger 1, a tubular member, such as the tubular member 2 and embodying the ribs 13 extending the full length thereof, may first be formed. Thereafter, the fins 4 may be successively formed on each of the side walls 7 and 8 from one end portion of the tubular member 2, such as end portion A, toward the other end B thereof, FIG. 1. The fins may each be cut or gouged from the walls 7 and 8 by means of suitable cutting tools such as the cutting tools 14 and 15, FIG. 1, which first cut along lengthwise of the ribs 13 to the right, as viewed in FIG. 1, to form the surfaces 16 which terminate at their lower ends, as viewed in FIG. 1, at the base 17 of the ribs 13, the cutting tools then continuing to cut along lengthwise of the portion 18 of the wall 7 or 8 underlying the ribs 13 to form the surface 19, FIG. 1. The fins 4, which have been cut or gouged from the walls 7 and 8 of the body portion 2, are then bent outwardly preferably to a position approximately perpendicular to the planes of the walls 7 and 8 on which they are formed.

After thus forming the fins 4 along the desired length of the tubular member 2, such as the length A-C, the tubular member 2 may be severed transversely to its length at the point C to thereby afford a finished heat exchanger element having fins 4 spaced along substantially the full length thereof. As will be appreciated by those skilled in the art, if desired, the formation of the fins 4 may be commenced inwardly of the end portion A of the tubular member 2, and the tubular member may be severed outwardly to the left, as viewed in FIG. 1, of the last formed fin 4 to thereby afford end portions which project outwardly from the outermost fins 4 to afford connecting members at each end of the finished heat exchanger. In such last mentioned construction, not shown, the ribs 13 of the tubular member 2 disposed outwardly of the aforementioned outermost fins, preferably are removed by suitable means, such as, for example, grinding, to thereby afford a smooth-walled end portion for the completed heat exchanger.

The method of making finned heat exchangers, thus far described herein, by cutting or gouging them from the opposite sides of a tubular member, has been heretofore known in the art, being shown, for example, in the previously mentioned patents. However, as previously mentioned, the faces of the fins of such heretofore known heat exchangers, corresponding to the sides or faces 20 of the fins 4, which face to the right, as viewed in FIG. 1, in the direction of the cutting movement of the cutters 14 and 15, only, are roughened, while the faces of the fins, corresponding to the faces 21 of the fins 4, shown in FIG. 1, facing to the left, are shiny smooth, as are the surfaces of the tubular member 2 from which these last mentioned faces are lifted. As will be discussed in greater detail hereinafter, in the practice of the method of the present invention, the faces 21 of the fins 4, as well as the faces 20 thereof are roughened, to thereby afford the previously mentioned advantageous performances of the fins 4.

In accordance with the principles of the preferred form of my present invention, the roughening of the faces or sides 21 of the fins 4 is accomplished by vibrating the cutting tools 14 and 15 with respect to the tubular member 2, during the formation of the fins 4, as will be discussed in greater detail hereinafter.

In FIGS. 1–2 of the drawings, apparatus, which is suitable for the practice of the preferred form of my invention is shown to illustrate a manner in which the invention may be practiced. This apparatus includes the two aforementioned cutter bars 14 and 15, each of which is operatively connected to a suitable mechanism 22 and 23, respectively, for forming the fins 4 in accordance with the principles of the present invention, as will be discussed in greater detail hereinafter.

The mechanisms 22 and 23 are somewhat similar to the mechanisms shown in my aforementioned co-pending patent application, Ser. No. 205,795, except that the cutter bars 14 and 15 of the mechanisms 22 and 23 are not transversely pivoted during cutting operations thereof, but are vibrated, as will be discussed in greater detail presently. The mechanisms 22 and 23 are identical in construction, except that they are mirror images of each other, and, therefore, parts of the mechanism 23, which are identical to corresponding parts of the mechanism 22 are indicated in the drawings by the same reference numerals as the corresponding parts of the mechanism 22.

The mechanism 22, FIG. 1, embodies an elongated, substantially rectangular-shaped cutter slide 24 slidably mounted in the bottom portion of a substantially inverted U-shaped, stationarily mounted cutter guide 25, for longitudinal reciprocation therethrough. The cutter guide 25 has a plurality of pins 26 mounted in the opposite side walls thereof and projecting into elongated grooves 27 formed in the respective opposite sides of the cutter slide 24, and extending the length thereof, for mounting the slide 24 in the cutter guide 25 for the aforementioned longitudinal reciprocation therethrough, only one side of the guide 25 and one groove 27 being shown herein.

The mechanism 22 also includes a substantially inverted U-shaped cross-head 28 movably mounted therein for vertical reciprocation relative to the cutter slide 24. The cross-head 28 embodies two vertically extending side walls 29 and 30, FIG. 1, disposed on opposite sides of the slide 24, the side walls 29 and 30 each having cam slots 31 disposed therein. Pins 32, one of which is shown in the drawings, are mounted in the opposite sides of the slide 24 and project outwardly through respective ones of the cam slots 31 in such position that vertical reciprocation of the cross-head 28 is effective to reciprocate slide 24 longitudinally through the guide 25 by reason of the engagement of the pins 32 with the side walls of the cam slots 31.

Figure 3:
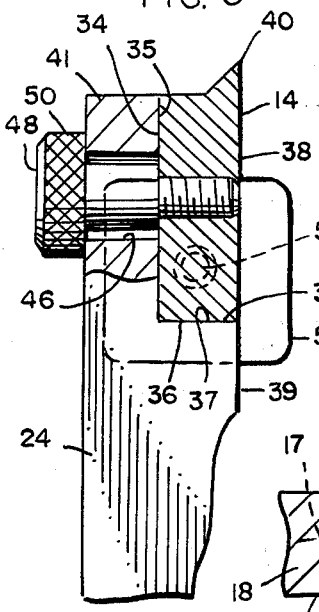
FIG. 3 is a fragmentary, detail sectional view taking substantially along the line 3—3 in FIG. 2.
Figure 4:
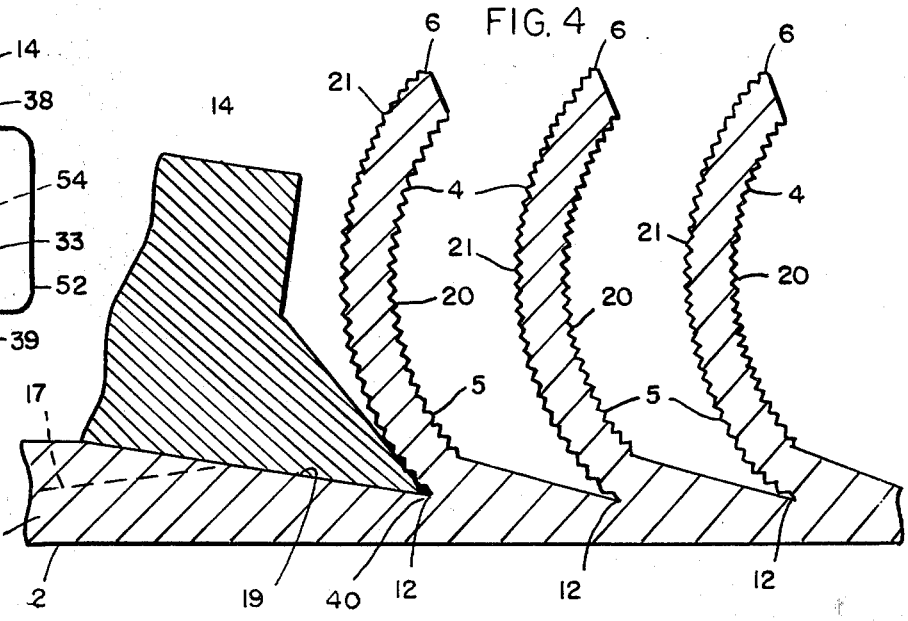
FIG. 4 is an enlarged, fragmentary, detail sectional view, similar to a portion of FIG. 1, but showing the cutter member at the end of completing a cutting or gouging stroke.

The slide 24 of the mechanism 22 has a rectangular-shaped recess formed in the front end portion thereof and extending transversely across the full width thereof, FIGS. 1, 2 and 3. The cutter bar 14 is of rectangular, cross-sectional shape, and is of such size that it will fit into the recess 33, with the top 34 of the cutter bar 14 disposed in abutting engagement with the top wall 35 of the slide 24; the rear face 36 of the cutter bar 14 disposed in abutting engagement with the rear wall 37 of the recess 33; the bottom 38 of the cutter bar 14 disposed in uniplanar relation to the bottom 39 of the slide 24; and the cutting edge 40 of the cutter bar 14 projecting outwardly beyond the front end 41 of the slide 24, FIGS. 1 and 3. The length of the cutter bar 14 is somewhat less than the lateral width of the slide 24, the ends 42 and 43 of the cutter bar 14 being disposed in inwardly spaced relation to the sides 44 and 45 of the slide 24, when the cutter bar 14 is disposed in operative position in the latter, FIG. 2.

The slide 24 has two elongated slots 46 and 47, FIG. 2, extending vertically through the top wall 35 of the recess 33, in substantially longitudinal alignment with each other, along the longitudinal center line of the top wall 35, and two bolts 48 and 49, having heads 50 and 51, respectively, resting on top of the top wall 35 of the recess 33, project downwardly through the recesses 46 and 47, respectively, and are threaded into the cutter bar 14 for slidably securing the latter in the recess 33 for longitudinal reciprocation therein. Preferably, the cutter bar 14 is secured to the slide 24 by the bolts 48 and 49 with a relatively snug, but freely slidable fit, so that it is firmly held in the recess 33 but is free to slide longitudinally therein.

A vibrator 52 is mounted on the slide 24 for movement therewith by suitable supporting means, such as a mounting bracket 53, FIG. 2, and embodies a vibratory shaft 54, FIGS. 2 and 3, suitably secured to the cutter bar 14, such as, for example, being threaded into one end thereof. The vibrator 52 may be of any suitable type readily available on the market, but, preferably, is of such type that it will longitudinally vibrate the cutter bar 14 at a rate of 12,000 to 15,000 vibrations per minute, for a purpose that will be discussed in greater detail presently.

From the foregoing it will be seen that vertical reciprocation of the cross-head 28 is effective through the engagement of the pins 32 with the side walls of the cam slots 31 therein to reciprocate the cutter slide 24 longitudinally through the cutter guide 21 and thus correspondingly reciprocate the cutter 14 through the cutting or gouging motions, heretofore mentioned, for forming fins, such as the fins 4.

The apparatus, of which the mechanism 22 forms a part, also includes a guide 55, FIG. 1, for a tubular member, such as the tubular member 2, for longitudinal movement of the tubular member 2 therethrough. The guide 55 is disposed in position to effectively support the tubular member 2 in position for the aforementioned cutting or gouging operations of the cutters 14 and 15 on tubular member 2.

It will be remembered that in forming the fins 4, the cutter 14 moves through a stroke of substantial length, such as, for example, a length of 1.125" at a relatively narrow depth of cut, such as, for example, a depth of 0.003", to produce a fin of substantially less length than the length of cut, such as, for example, a length of 0.4" and having a thickness substantially greater than the depth of cut, such as for example, a thickness of 0.009". As previously mentioned, it has been found that such skiving operations form a roughened or bubbled surface on one side of the fins 4, namely the sides 20 thereof, while leaving the other sides 21 of the fins 4 shiny-smooth. In the practice of the present invention, at all times during the reciprocation of the slide 24 of the mechanism 22, the vibrator 52 is energized to thereby cause the shaft 54 to vibrate longitudinally at a relatively rapid rate, such as, for example, at the aforementioned rate of 12,000 to 15,000 vibrations per minute.

Such vibration of the cutter bar 14 is for the purpose of causing roughening of the faces 21 of the fins 4 to a depth in the nature of 0.001", and with the roughened portions spaced from each other, between the roots 12 of the fins 4 and the free edges thereof, in the nature of thirty-five to forty-five, and preferably, forty roughened areas per fin.

With the fins 4 formed in the aforementioned manner, and in accordance with the principles of the present invention, it will be seen that both the faces 20 and 21 thereof are roughened. This roughening of the faces 21 of the fins 4 is effective to afford a heat-transfer surface area which is greater than that of the shiny surfaces heretofore known in the art; affords a surface which assists in breaking up laminar flow past the fins 4; creates increased turbulence in the working fluid passing between the fins 4; and tends to break up the boundary layers of working fluid disposed immediately adjacent to the faces 21.

The operation of the mechanism 23 is the same as that of the mechanism 22, except that the mechanism 23 is disposed below the tubular member 2, and operates on the lower face thereof, and, of course, both mechanisms 22 and 23 are operated simultaneously on a tubular member, such as the member 2, passing through the guide 55.

In FIGS. 5–6, a modified form of the present invention is illustrated, and parts which are the same as parts shown in FIGS. 1–4 are indicated by the same reference as the corresponding parts shown in FIGS. 1–4, and parts which are similar to, but are different from corresponding parts shown in FIGS. 1–4 are indicated by the same reference numerals with the suffix "b" added thereto.

In FIGS. 5–6, apparatus is illustrated whereby, like the apparatus shown in FIGS. 1–4, the work-piece and cutters are vibrated relative to each other during the aforementioned fin-forming operations but, wherein, rather than the cutters, such as the cutters 14 and 15 of the apparatus shown in FIGS. 1–4, being vibrated relative to the work-piece or tubular member 2, the work-piece or tubular member 2 is vibrated relative to the cutters during the fin-forming operations.

In the apparatus shown in FIGS. 5–6, the guide **55*b* for the work-piece or tubular member 2 is slidably mounted by a pin or rod 56 extending through and slidably mounted in a passageway 57 in the upper portion 58 of a mounting base 59. The rod 56 is mounted in and secured to two ears 60 and 61 on the guide 55*b*, the ears 60 and 61 being disposed in outwardly spaced relation to opposite sides of the upper portion 58 of the base 59, so that the rod 56** may be longitudinally reciprocated relative to the latter.

A vibrator **52*b* is mounted on the base 59 and has a vibratory shaft 54*b* extending therefrom and secured to the guide 55*b* by suitable means such as being threaded thereinto. In the operation of the apparatus illustrated in FIGS. 5–6, the tubular member 2 passes through an opening 62 in the guide 55*b*, and is disposed therein with a relatively snug, but freely slidable fit. During such passage of the tubular member 2 through the guide 55*b*, the vibrator 52*b* is effective, through its connection to the guide 55*b* by the rod 54*b*, to vibrate the guide 55*b* longitudinally of the rod 56 and thereby cause vibration of the tubular member 2** relative to the cutters, performing the cutting or gouging operations thereon.

If desired, the cutting apparatus used with the apparatus shown in FIGS. 5–6 may be vibrated, in the same manner as heretofore discussed with respect to the apparatus shown in FIGS. 1–4, but it is presently preferred that, when the relative vibration between the work-piece and the cutter members is afforded by vibration of the work-piece, such as, for example, by the apparatus shown in FIGS. 5–6, the cutter members operating on the work-piece not be vibrated simultaneously therewith. This, of course, may be readily accomplished when using apparatus of the type shown in FIGS. 1–4 in cooperation with the apparatus shown in FIGS. 5–6 by merely eliminating the vibrators 52 and securing the cutters 14 and 15 on their respective slides 24 with a snug, non-slidable fit, by suitably tightening the bolts 48 and 49.

From the foregoing it will be seen that the present invention affords a novel method of making heat exchangers.

In addition, it will be seen that the present invention affords a novel method of making a heat exchanger having improved heat-transfer characteristics between the fins thereof and the working fluid passing therebetween.

In addition, it will be seen that the present invention affords a novel method of making heat exchangers which is practical and efficient in operation and which may be readily and economically accomplished.

Thus, while I have illustrated and described the preferred embodiments of my invention, it is to be understood that these are capable of variation and modification, and I therefore do not wish to be limited to the precise details set forth but desire to avail myself of such changes and alterations as falls in the purview of the following claims.

I claim:

1. The method of forming fins on the surface of a heat exchange element which comprises the steps of (a) feeding an elongated tubular body member longitudinally past a cutter, (b) reciprocating said cutter forwardly and rearwardly toward and away from said surface at an acute angle and cutting into said surface during the forward movement thereof in a skiving action, thereby to form an upstanding fin, one side of which is integral with said body, and (c) imparting relative vibration between said cutter and said body during said forward movement of said cutter, (d) thereby to produce a roughened surface on the cutter-adjacent side of the fin thus formed.

2. The method of forming fins on the surface of a heat exchange element as defined in claim 1, wherein the relative vibration between said cutter and said body is caused by vibrating said cutter.

3. The method of forming fins on the surface of a heat exchange element as defined in claim 1, wherein the relative vibration between said cutter and said body is caused by vibrating said body.

4. The method of forming fins on the surface of a heat exchange element as defined in claim 1, wherein the relative vibration between said cutter and said body is in a direction transverse to the movement of said cutter and said body.

5. The method of forming fins on the surface of a heat exchange element as defined in claim 2, wherein the vibratory motion of said cutter is in a direction transverse to the cutting movement thereof.

6. The method of forming fins on the surface of a heat exchange element as defined in claim 3, wherein the vibratory motion of said body is in a direction transverse to the direction of feed of said body.

* * * * *